United States Patent [19]

Vazquez

[11] Patent Number: 4,526,404

[45] Date of Patent: Jul. 2, 1985

[54] CONTAINER FOR CLINICAL PRODUCT

[76] Inventor: Richard M. Vazquez, 716 W. Hutchinson, Chicago, Ill. 60613

[21] Appl. No.: 489,715

[22] Filed: Apr. 29, 1983

[51] Int. Cl.[3] ..... B42D 15/00; G09F 3/00; B65D 79/00

[52] U.S. Cl. ..... 283/79; 40/310; 206/232

[58] Field of Search ..... 283/81, 900, 79; 40/312, 310, 3 R; 604/189, 408; 206/232, 447

[56] References Cited

U.S. PATENT DOCUMENTS

| | | | |
|---|---|---|---|
| 1,686,354 | 10/1928 | Wallace | 206/232 |
| 3,266,298 | 8/1966 | Whitehead et al. | 604/189 |
| 3,517,450 | 6/1970 | Greco | 40/310 |
| 3,905,477 | 9/1975 | Graham | 604/189 |
| 4,128,954 | 12/1978 | White | 40/310 |
| 4,312,523 | 1/1982 | Haines | 283/81 |
| 4,329,191 | 5/1982 | Barber | 283/81 |
| 4,365,629 | 12/1982 | Pert et al. | 604/408 |

*Primary Examiner*—Paul A. Bell
*Assistant Examiner*—Paul M. Heyrana, Sr.
*Attorney, Agent, or Firm*—Marshall, O'Toole, Gerstein, Murray & Bicknell

[57] ABSTRACT

A label-bearing container for a clinical product in which the product label functions to identify the product contents and can be removed and posted in a patient's hospital chart. In a preferred embodiment the product label will contain areas for entry of clinical observations. The labeled container is particularly useful for the dispensing of blood products.

11 Claims, 6 Drawing Figures

CONTAINER FOR CLINICAL PRODUCT

BACKGROUND OF THE INVENTION

The present invention relates to apparatus for ensuring the proper dispensing of clinical products administered in a hospital or patient-care facility. The apparatus is particularly useful in connection with products which are infused into the bloodstream of a patient, such as blood products, intravenous fluids, and the like.

Proper administration of intravenous products is an important medical consideration. For example, in the case of blood, use of an improperly matched blood product in a patient can result in severe consequences. For this reason, current clinical practice requires careful patient blood type cross-matching prior to administering a blood product. This results in an amount of documentation which is necessarily associated with a unit of blood product infused in a patient.

Blood products are customarily packaged in sealed disposable containers. While in the custody of the blood bank, each blood container has a permanent label which identifies the product by blood group, Rhesus factor, and donor. When an initial request for blood for a patient is made, a unique identification number is assigned to the patient and a sample of the patient's blood is tested to establish the blood type. The recipient's blood is then cross-matched with a unit of donor blood of the same type. The crossmatched blood product is selected by personnel in the blood bank, coded with the patient's identification number, and the blood product and accompanying paperwork released by the blood bank for administration to the patient.

Blood products are often administered in critical care or life-threatening situations. Understandably, the documentation associated with the blood product becomes of secondary importance under these conditions. Thus it is not uncommon for information as to the number of blood units administered, and the specific blood product component—whole blood, platelet rich infusions, packed red blood cells, etc.—to be missing from the patient's chart, or for a single unit of blood product to be referred to a number of times in the patient's records so that it is not apparent to medical personnel responsible for the post-transfusion care of the patient whether one or several units of blood product have been administered.

As a result, much inconvenience and wasted time is encountered by medical consultants whose duty is to establish the previous use of blood component products since their recommendations as to a subsequent course of treatment for the patient is dependent, in part, on the nature of the prior treatment. Not only is this undesirable from a medical viewpoint, but the patient may also be able to successfully challenge the charges incurred for blood product services since the documentation may be very sketchy.

The present invention provides apparatus which preserves the critical cross-matching information which accompanies the blood product, and provides a means whereby the information as to the nature, type and amount of blood infused can be easily entered in the patient's medical record.

This is accomplished by means of a printed label removably mounted on the blood product container which contains information pertinent to the product, as well as areas for entering notations as to the date and time of administration, etc. In a preferred embodiment, the label is provided with a first adhesive area for adhering the label to the blood container, and a second, pressure-sensitive adhesive area which allows the label to be removed from the blood container and to be mounted or pasted in the patient's record. In other words, the self-adherent label is designed to serve a dual purpose, i.e., provide information concerning the blood product while mounted on the blood product container and to serve as a replacement for a hand-written progress note in the patient's hospital chart after the product has been administered. Needless duplication of information is thus kept to a minimum.

It is preferred to mount the label on the blood product container so that the removable, self-adherent portion of the label covers the infusion ports on the container. In order to obtain easy access to the contents of the container, it is necessary for the individual administering the blood product to "peel off" the self-adherent label. The label is then placed in the patient's medical chart or transferred to an intermediate location for eventual transfer to the chart. Because each unit of blood product will have a separate unique label, the amount and type of blood product administered can be readily determined.

Other information concerning the product could be conveyed by means of smaller secondary labels which are attached to the primary drainage-port-covering label by blood bank personnel. One such secondary label could be both color coded to the type of blood product being infused and have a bold-face abbreviation of the contents, e.g., a red label with PRBC (packed red blood cells) imprinted upon it. In addition, a label readable by data processing equipment, such as an optically scannable bar code could be generated and applied by blood bank personnel to each blood product package label. This latter label will contain all information necessary to identify with certainty the contents of the package and its intended recipient, the patient.

In a suitably-equipped hospital it will be possible to utilize the information encoded on the blood product label to "double check" the contents. Immediately prior to infusion of the product this secondary portion of the label will be exposed to data scanning equipment at the patient's bedside. A mismatch of product/patient identity will put the system into an alarm mode. A proper match will automatically register a charge for the service and/or product, at the time of the infusion.

Although the package of the present invention is particularly useful for dispensing blood products, it is also applicable to liquid products destined to be infused in a patient, either intravenously or intraintestinally. The package could also be employed with products prepared in the hospital pharmacy, such as tablets, capsules, injections, and suppositories, to assist in patient record-keeping and to safe-guard against improper adminstration of a drug product.

DETAILED DESCRIPTION OF THE INVENTION

Figure 1:
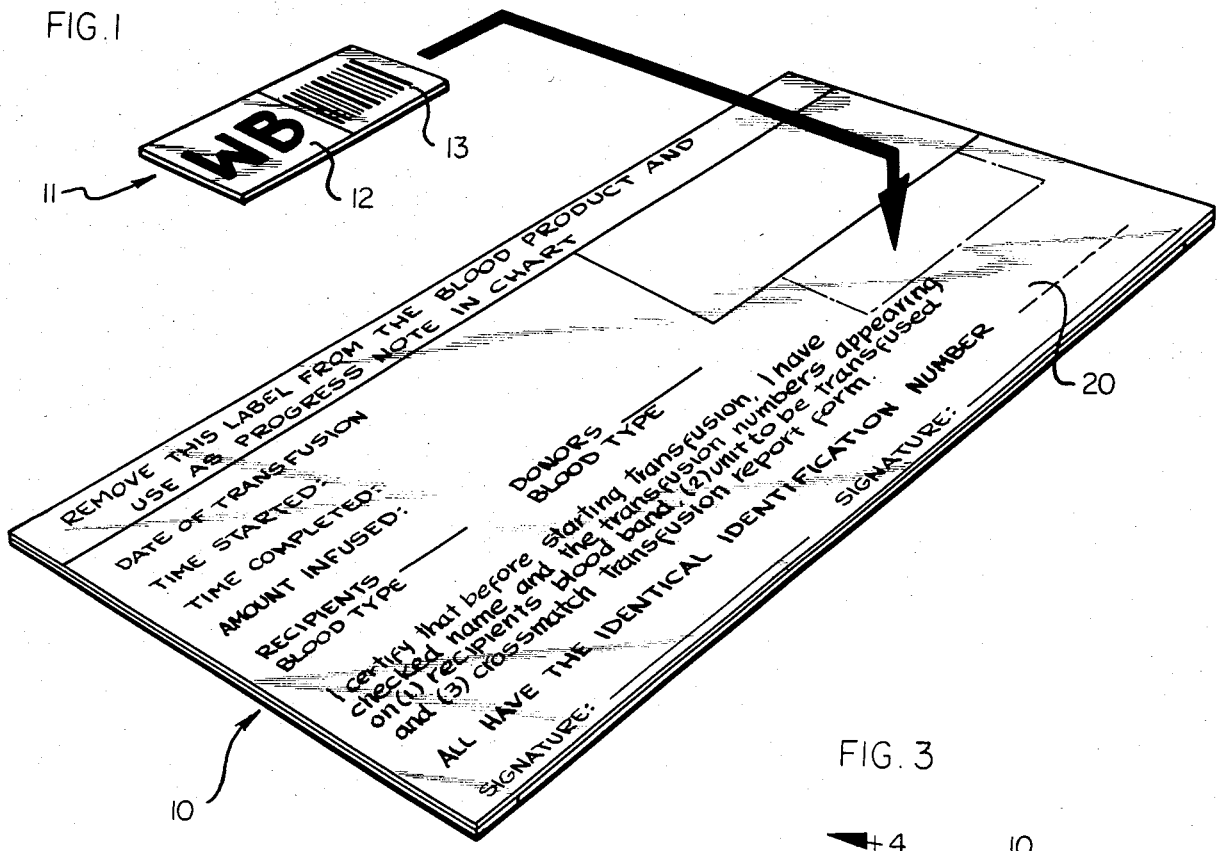
FIG. 1 is a perspective view showing the top, printed side of a first label designed to be used with a blood product and a secondary label for mounting on the first label.

Referring now to FIG. 1, there is shown a first label 10 designed to be employed with a blood product such as whole blood, platelet rich infusions, packed red blood cells, etc. First label 10 has a face side 28 which bears printed indicia and areas for typed or handwritten notations. When completed, label 10 contains enough information concerning the contents of a blood package so as to ensure that the product is administered to the proper patient as well as essential information which can be posted in the patient's hospital medical record or chart.

A smaller secondary label 11 can be mounted on the face 28 of first label 10 to provide additional information about the contents. Secondary label 11, as illustrated, bears the notation "WB" which signifies "whole blood". In a preferred embodiment, the background 12 on which the notation appears could be color coded as an additional indication of contents—i.e., blue and white checkered for whole blood (WB), red for packed red blood cells (PRBC), purple for platelet rich infusions (PLTS), etc. An optional optically scannable bar code 13, containing encoded information about the patient for whom the product has been prescribed, can be provided to further insure administration of the proper blood product.

First label 10 also has a blank area 26 for recording additional information concerning the patient. This area can be imprinted with the data embossed on a plastic "charge card" made for the patient upon admission to a hospital. (See, FIG. 3). This card usually contains information such as the patient's name, birth date, Social Security number, hospital room number, and the name of the patient's attending physician.

Figure 2:
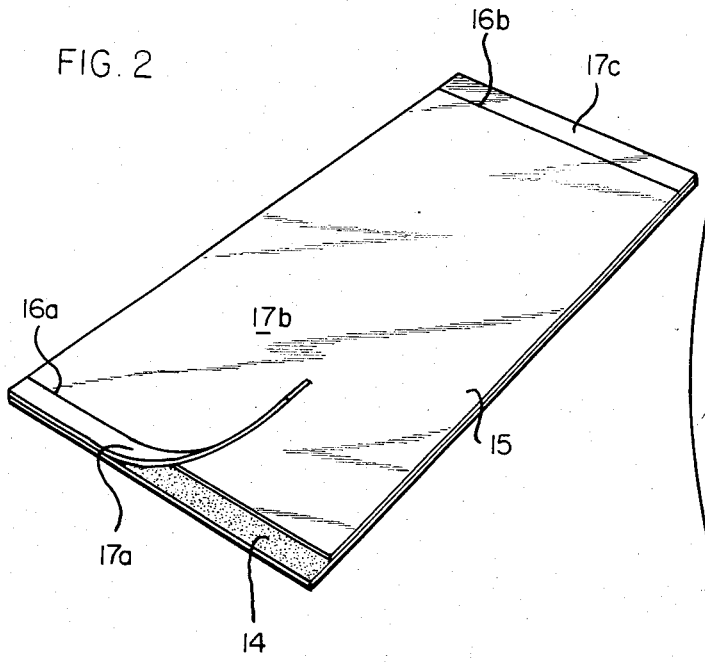
FIG. 2 is a view of the reverse side of the label shown in FIG. 1 showing the removal of an adhesive masking strip prior to attaching the label to a blood product container.
Figure 3:
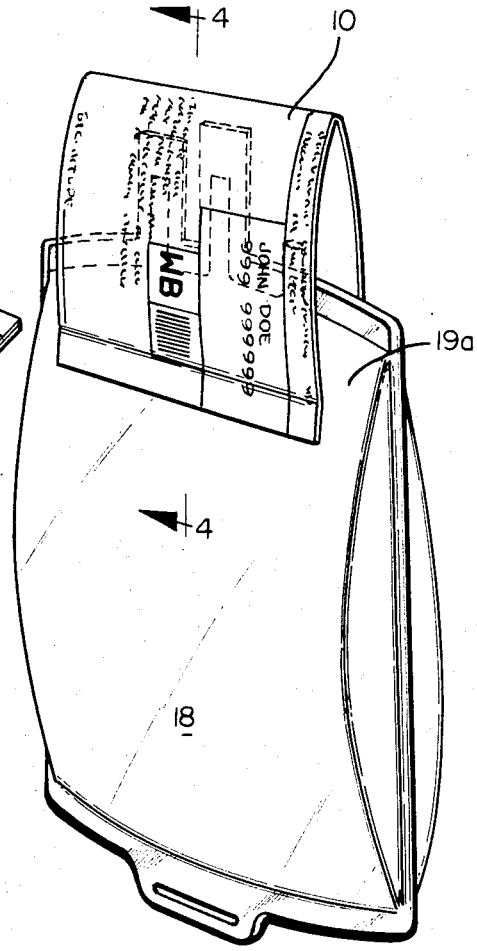
FIG. 3 is a perspective view, partially in phantom, showing the label of FIG. 1 mounted on a blood container in a manner blocking the blood drainage ports.

Referring now to FIGS. 1 through 3, first label 10 is manufactured of paper or other flexible sheet material capable of being written upon. The reverse side of label 10 is coated with a pressure sensitive adhesive 14. Adhesive 14 is masked by a releasable backing 15 for maintaining adhesive 14 tacky until it is ready for use. A suitable material for this purpose is silicone treated paper, widely used as paper backings for adhesive coated products.

Figure 4:
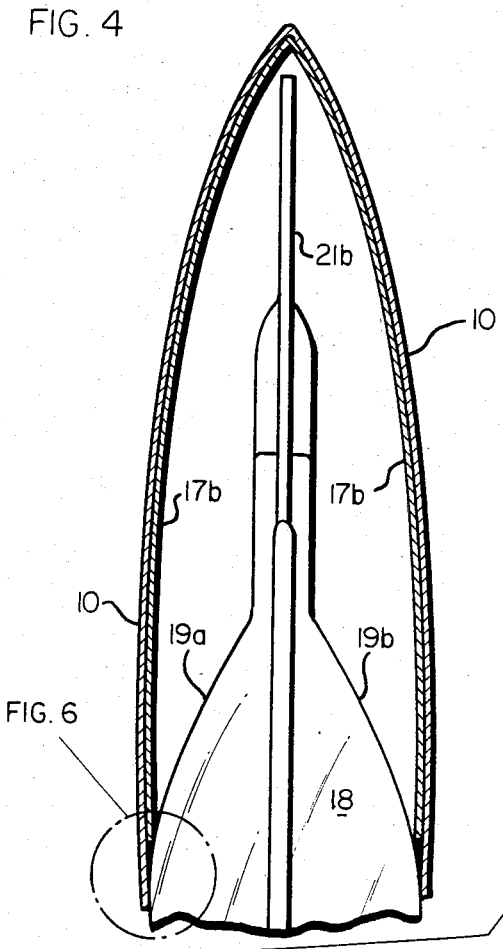
FIG. 4 is a fragmentary side elevational view of the blood container and label of FIG. 3.

Score lines 16*a*, 16*b* divide backing 15 into three masking strips 17*a*, 17*b* and 17*c*. Label 10 may be readily attached to a blood product container 18 by removing strips 17*a* and 17*c* covering peripheral side portions 24*a*, 24*b* of adhesive 14, and contacting the sidewalls 19*a*, 19*b* of container 18 with the exposed adhesive portions (FIG. 4). Control masking strip 17*b* of backing 15 is retained in its normal adhesive-covering position until time for insertion in the patient's chart (See FIG. 5).

In order to appreciate the apparatus illustrated, it is helpful to understand the operation of the blood dispensing process in a hospital environment. This procedure is generally initiated by a transfusion requisition by a physician for a specific blood product for a particular patient. If this is the first request for blood for the patient, the order is accompanied by a specimen of the patient's blood for typing and screening.

Hospitals typically have a central repository for blood products to deal with transfusion requisitions and requests for blood typing and screening. These "blood banks" perform the blood analysis requested and select the proper blood product for administration to the patient. A unique number is assigned to the patient and blood product to ensure the proper match. A bracelet or "blood band" (not shown) containing this number is prepared to be attached to the patient's wrist, and the same number is posted on label 10, at 20. The bracelet can be optical scanner encoded with a unique code to match this identification number.

Blood product container 18 is a disposable package manufactured of a thermoplastic material. Container 18 has a plurality of ports (21)*a*, 21*b* and 21*c* (FIG. 5) for insertion of filling and infusion tubing. Port 21*c* is utilized in the preparation of the blood product at a regional blood center (i.e., in filling blood product container 18). Ports 21*b* and 21*c* are used in discharging the container's contents. To administer blood contents to a patient, protective tab 27 (FIG. 5) is peeled away from infusion port 21*b* and infusion tubing interconnecting the patient and blood product is inserted in container 18.

In addition to identification number 20, blood bank personnel prepare the entries on label 10 relating to the blood donor and recipient blood type, etc. Secondary label 11 showing the type of blood product is attached to main label 10 which can then be mounted across ports 21*a, b, c* of container 18 by removing adhesive masking strips 17*a*, 17*b* and attaching the label as shown in FIG. 3. The labeled blood package is then directed to the physician who initiated the transfusion requisition.

Figure 6:
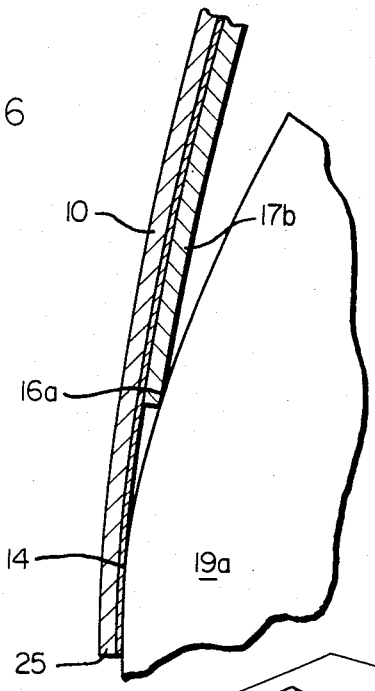
FIG. 6 is an enlarged fragmentary sectional view of the apparatus of FIG. 4 showing the adhesive attachment between the label and the blood product container.

FIGS. 4 and 6 illustrate the attachment of label 10 to sidewalls 19*a*, 19*b* of blood container 18 in greater detail. With masking strips 17*a* and 17*c* removed, adhesive 14 bonds label 10 to sidewalls 19*a, b*. Masking strip 17*b*, however, covers a large area of the rear side of label 10, preventing the label from adhering to a drainage port 21.

Figure 5:
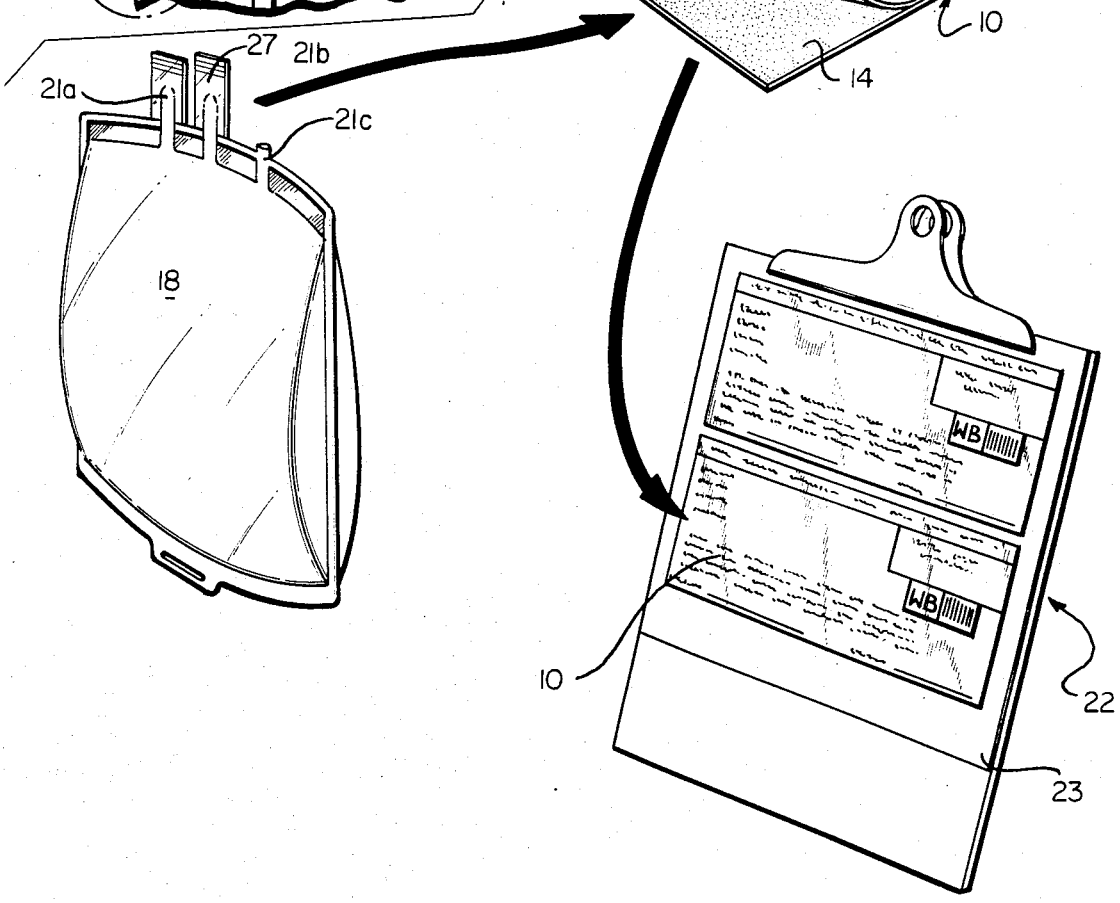
FIG. 5 is a diagramatic view showing the removal of the first label from the blood container, the peeling of a releasable adhesive masking strip from the rear of the label, and the insertion of the label into a patient's hospital chart.

Referring now to FIGS. 3, 5 and 6, container 18 arrives at the dispensing location in the FIG. 3 condition, i.e., with drainage ports 21*a, b, c* covered by label 10. In order to obtain access to the contents of the container, it is necessary to remove label 10 from container 18. The adhesive bond between the label 10 and container sidewalls 19*a*, 19*b* is strong enough to hold the label in place, but may be easily broken by peeling an edge 25 of the label away from contact with the container. Label 10 can be transferred immediately to a patient hospital chart 21 by removing masking strip 17*b* and securing label 10 to a page 23 of chart 22 by means of adhesive 14. Alternatively (not shown), in an emergency situation label 10 can be temporarily transferred to an intermediate location (i.e., to the physician's shirt, the drainage tubing, etc.), and held in the temporary location by means of the adhesive along peripheral portion 24*b* (FIG. 5). Thereafter label 10 can be easily transferred to the patient's hospital chart 22.

In an alternative embodiment (not shown), label 10 can be perforated at 16*a*, 16*b*. This permits the use of a stronger adhesive in the area of peripheral side portions 24*a*, 24*b* (i.e., the portion of the label rear covered by masking strips 17*a* and 17*c*) and a correspondingly tighter bond between label 10 and container sidewalls 19*a*, 19*b*. Label 10 can be severed at these score lines, allowing the label to be detached from container 18 and inserted into chart 22.

As shown in FIG. 1, label 10 has a number of entries to be completed by the person administering the blood product after the label has been inserted in chart 22. A large amount of pertinent information, however, is already contained on the label and thus need not be duplicated.

In summary, the package is adapted so that the label must be removed and relocated to obtain access to the container's contents. The label is designed so that a minimum amount of additional information need be recorded for the label to function as a full and complete record of the treatment provided the patient. Moreover, the additional entries required are largely in the nature of clinical observations rather than entries of a bookkeeping nature. All these factors encourage entry of the label into the patient's hospital chart by the personnel adminstering the blood or other medicinal product.

What is claimed:

1. In a container for dispensing a medicinal product, said container having (i) a product access port, and (ii) a first label having a front surface for identifying the container's contents and a rear surface, the improvement comprising:

means for removeably mounting said first label across said product access port such that access to said port is blocked by said label; and an adhesive material on said rear surface of the first label for posting said label in a patient record.

2. The improvement of claim 1 further including a secondary label mounted on said first label front surface for further identifying said container's contents.

3. The improvement of claim 2 wherein said secondary label is color-coded to identify the container's contents.

4. The improvement of claim 2 wherein said secondary label contains an optically scannable bar code.

5. A blood product container having at least one infusion port for access to the container's contents;

a first label for mounting on said blood product container, said label having printed indicia on a label face side and an adhesive coating on a label reverse side;

a releasable adhesive masking strip covering a portion of said adhesive coating; and said first label removeably mounted on said blood container across said infusion port such that access to said port is blocked by said label.

6. The improvement of claim 5 further including a secondary label mounted on said first label face side for further identifying said container's contents.

7. The improvement of claim 6 wherein said secondary label is color-coded to identify the container's contents.

8. The improvement of claim 6 wherein said secondary label contains an optically scannable bar code.

9. The improvement of claim 5 wherein the portion of said adhesive coating on said label covered by said strip comprises means for posting said label in a patient's record.

10. The improvement of claim 5 further including means on said label face side for entry of handwritten notations.

11. The improvement of claim 5 wherein said label reverse side has a pair of peripheral side portions adhesively engaged to said blood product container.

* * * * *